US007748807B2

(12) United States Patent
Jones et al.

(10) Patent No.: US 7,748,807 B2
(45) Date of Patent: Jul. 6, 2010

(54) OFF-RADIAL-AXIS CIRCULAR PRINTING DEVICE AND METHODS

(75) Inventors: Randy Quinn Jones, Sunnyvale, CA (US); Carl Eric Youngberg, Mapleton, UT (US); Clayton Grant Gardner, Alamo, CA (US); Robert Steven Struk, Sunnyvale, CA (US); Thomas John Lugaresi, Los Gatos, CA (US); Michael Ralph Thompson, Los Gatos, CA (US); George Lynn Bradshaw, Palo Alto, CA (US); James Charles Brick, Sunnyvale, CA (US); Jan Eugene Unter, Alamo, CA (US)

(73) Assignee: Elesys, Inc., Sunnyvale, CA (US)

( * ) Notice: Subject to any disclaimer, the term of this patent is extended or adjusted under 35 U.S.C. 154(b) by 0 days.

(21) Appl. No.: 11/359,193

(22) Filed: Feb. 21, 2006

(65) Prior Publication Data

US 2006/0209102 A1 Sep. 21, 2006

Related U.S. Application Data

(63) Continuation-in-part of application No. 11/117,936, filed on Apr. 28, 2005, and a continuation-in-part of application No. 10/127,948, filed on Apr. 22, 2002, now Pat. No. 6,986,559, and a continuation-in-part of application No. 10/207,662, filed on Jul. 26, 2002, now Pat. No. 7,085,017, and a continuation-in-part of application No. 10/935,805, filed on Sep. 7, 2004, now Pat. No. 7,284,804, which is a continuation-in-part of application No. 10/125,681, filed on Apr. 18, 2002, now Pat. No. 6,786,563, and a continuation-in-part of application No. 11/058,941, filed on Feb. 15, 2005, now abandoned, which is a continuation-in-part of application No. 10/125,777, filed on Apr. 17, 2002, now Pat. No. 6,854,841, and a continuation-in-part of application No. 09/062,300, filed on Apr. 17, 1998, now Pat. No. 6,264,295, and a continuation-in-part of application No. 10/159,729, filed on May 30, 2002, now Pat. No. 6,910,750, which is a continuation-in-part of application No. 09/872,345, filed on Jun. 1, 2001, now abandoned, and a continuation-in-part of application No. 10/848,537, filed on May 17, 2004, now Pat. No. 7,497,534, which is a continuation-in-part of application No. 09/815,064, filed on Mar. 21, 2001, now Pat. No. 6,736,475.

(60) Provisional application No. 60/654,168, filed on Feb. 18, 2005, provisional application No. 60/566,468, filed on Apr. 28, 2004, provisional application No. 60/285,487, filed on Apr. 20, 2001, provisional application No. 60/310,303, filed on Aug. 3, 2001, provisional application No. 60/284,847, filed on Apr. 18, 2001, provisional application No. 60/284,605, filed on Apr. 17, 2001, provisional application No. 60/208,759, filed on Jun. 2, 2000, provisional application No. 60/191,317, filed on Mar. 21, 2000.

(51) Int. Cl.
*B41J 3/00* (2006.01)
*B41J 29/38* (2006.01)
*B41J 2/01* (2006.01)

(52) U.S. Cl. ..... 347/2; 347/9; 347/14; 347/16; 347/101

(58) Field of Classification Search ..... 347/2, 347/5, 8, 9, 14, 16, 19, 101, 104, 107; 358/1.11, 358/1.18; 101/35; 346/137
See application file for complete search history.

(56) References Cited

U.S. PATENT DOCUMENTS 5,317,337 A * 5/1994 Ewaldt ..... 347/2
5,398,049 A * 3/1995 Terasawa et al. ..... 347/8
5,444,687 A * 8/1995 Okumura ..... 369/47.19
5,518,325 A * 5/1996 Kahle ..... 400/70
6,074,031 A * 6/2000 Kahle ..... 347/4
6,182,565 B1 * 2/2001 Takayama et al. ..... 101/35
6,264,295 B1 * 7/2001 Bradshaw et al. ..... 347/2
6,312,174 B1 * 11/2001 Drynkin et al. ..... 400/120.16
6,827,419 B2 * 12/2004 Buibas et al. ..... 347/19

2002/0145636 A1 * 10/2002 Jones et al. ..... 347/2

FOREIGN PATENT DOCUMENTS

JP 09265760 A * 10/1997
WO WO 9954141 A1 * 10/1999

* cited by examiner

*Primary Examiner*—Stephen D Meier
*Assistant Examiner*—Leonard S Liang
(74) *Attorney, Agent, or Firm*—Law Offices of Wayne Jones

(57) ABSTRACT

Method and apparatus for printing onto a rotating media is described. According to one embodiment, the printing system includes a print head that is laterally displaced from a radial printing radius, a rotating mechanism to rotate the media, and a controller to print onto an annular print area. The annular print area is defined by an inner hub circumference, two lines substantially parallel to the radial printing radius and tangential to the inner hub circumference, and an outer edge of the media. The print head moves about the annular print area by one or more motion mechanism and prints images onto the media.

32 Claims, 13 Drawing Sheets

Prior Art

500

Custom ATAPI Command Block

| Byte \ Bit | 7 | 6 | 5 | 4 | 3 | 2 | 1 | 0 |
|---|---|---|---|---|---|---|---|---|
| 0 | Operation Code (F3h) | | | | | | | |
| 1 | LUN (Obsolete) | | | mode (1ch) | | | | |
| 2 | Reserved | | Sled Dir | Sled ON | Rotate Speed | | | SS |
| 3 | Reserved | | | | | | Reset | SC |
| 4 | Reserved | | | | | | | |
| 5 | Reserved | | | | | | | |
| 6 | Reserved | | | | | | | |
| 7 | Reserved | | | | | | | |
| 8 | Reserved | | | | | | | |
| 9 | Reserved | | | | | | | |
| 10 | Reserved | | | | | | | |
| 11 | Control | | | | | | | |

504 502 515 512 514 510 506 516

520

Status Response Block

| Byte \ Bit | 7 | 6 | 5 | 4 | 3 | 2 | 1 | 0 |
|---|---|---|---|---|---|---|---|---|
| 0 | Data Length (=0) (MSB) | | | | | | | |
| 1 | Data Length (=1) (LSB) | | | | | | | |
| 2 | Reserved | | | | Status | | | |
| 3 | Reserved | | | | | | | |

522

550

Custom Drive Commands

NOTE: Enter "0" for all "Reserved" fields above.

(1) Mode (1ch): Indicates the state when drive is in custom 1x slow mode.

552 (2) SS (1x FG Spindle Servo): Enable 1x Rotation Speed
0b: OFF
1b: ON 554 (3) Rotate Speed: Set Rotation Speed (This setting enables when "SS" is set ON)
000b: 1x Faster (500 RPM)
001b: 1x Slower (400 RPM)
else: Reserved 556 (4) Sled ON: Move OPU (laser optical power unit)
0b: OFF
1b: ON 558 (5) Sled Dir (Sled Direction): Position the OPU (This setting is enabled if "Sled ON" is set ON)
0b: Inside
1b: Outside (6) SC (Status Check): current status check
0b: Check OFF
1b: Check ON

560

Return Status
0000b: Normal operation
0001b: Spindle Motor is still rotating under Normal Operation.
Prepare for Custom Mode:
0010b: 1x Rotation
0100b: OPU is outside.
1000b: OPU is inside
7) Reset: Return to Normal Operation
0b: No change
1b: Yes, Return to Normal Operation

562

Normal Drive Operation settings:
"SS"=OFF
"Sled ON"=OFF
"SC"=OFF.

FIG. 14

OFF-RADIAL-AXIS CIRCULAR PRINTING DEVICE AND METHODS

CROSS-REFERENCE TO RELATED APPLICATIONS

This application claims the benefit of U.S. Provisional Application No. 60/654,168 filed Feb. 18, 2005 entitled OFF-RADIAL-AXIS CIRCULAR PRINTING DEVICE AND METHODS, which is incorporated herein by reference in its entirety for all purposes.

This application is also a continuation-in-part of U.S. Utility patent application Ser. No. 11/117,936, filed Apr. 28, 2005, now published as U.S. Publication No. 2005/0206661 on Sep. 22, 2005 entitled RADIAL SLED PRINTING APPARATUS AND METHODS, which claims the benefit of U.S. Provisional Application No. 60/566,468, filed Apr. 28, 2004 and U.S. Provisional Application No. 60/654,168, filed Feb. 18, 2005 and which is a continuation-in-part of U.S. Utility patent application Ser. No. 10/127,948 filed Apr. 22, 2002, now U.S. Pat. No. 6,986,559, issued Jan. 17, 2006, entitled POSITION INFORMATION APPARATUS AND METHODS FOR RADIAL PRINTING, by Carl E. Youngberg, which claims the benefit of U.S. Provisional Application No. 60/285,487 filed Apr. 20, 2001; and is a continuation-in-part of U.S. Utility patent application Ser. No. 10/207,662 filed Jul. 26, 2002 now U.S. Pat. No. 7,085,017 entitled POLAR HALFTONE METHODS FOR RADIAL PRINTING, which claims the benefit of U.S. Provisional Application No. 60/310,303, filed Aug. 3, 2001; and is a continuation-in-part of U.S. patent application Ser. No. 10/935,805 filed Sep. 7, 2004, now U.S. Pat. No. 7,284,804 now published as U.S. Publication No. 2005/0078142 on Apr. 14, 2005 which is a continuation-in-part of U.S. Utility patent application Ser. No. 10/125,681 filed on Apr. 18, 2002, now U.S. Pat. No. 6,786,563, issued Sep. 7, 2004 entitled INTERLEAVING APPARATUS AND METHODS FOR RADIAL PRINTING, by Randy Q. Jones, which claims the benefit of U.S. Provisional Application No. 60/284,847 filed Apr. 18, 2001; and is a continuation-in-part of U.S. patent application Ser. No. 11/058,941, filed Feb. 15, 2005 now abandoned, which is a continuation-in-part of U.S. Utility patent application Ser. No. 10/125,777 filed on Apr. 17, 2002, now U.S. Pat. No. 6,854,841, issued Feb. 15, 2005, entitled POINT OF INCIDENCE INK CURING MECHANISMS FOR RADIAL PRINTING by Jan E. Unter, which claims the benefit of U.S. Provisional Application No. 60/284,605 filed Apr. 17, 2001 and which is a continuation-in-part of 09/062,300 filed on Apr. 17, 1998, now U.S. Pat. No. 6,264,295; and is a continuation-in-part of U.S. patent application Ser. No. 10/159,729 filed on May 30, 2002, now published as U.S. Publication No. 2002/0145636 on Oct. 10, 2002, now U.S. Pat. No. 6,910,750, issued Jun. 28, 2005, entitled LOW PROFILE INK HEAD CARTRIDGE WITH INTEGRATED MOVEMENT MECHANISM AND SERVICE-STATION by Randy Q. Jones et al., which is a continuation-in-part of U.S. Utility patent application Ser. No. 09/872,345 filed Jun. 1, 2001 (abandoned), which claims the benefit of U.S. Provisional Application No. 60/208,759 filed Jun. 2, 2000; and is a continuation-in-part of U.S. patent application Ser. No. 10/848,537 filed May 17, 2004 now U.S. Pat. No. 7,497,534, now published as U.S. Publication No. 2004/0252142 on Dec. 16, 2004, which is a continuation-in-part of U.S. Utility patent application Ser. No. 09/815,064 filed on Mar. 21, 2001, now U.S. Pat. No. 6,736,475, issued May 18, 2004, entitled METHOD FOR PROVIDING ANGULAR POSITION INFORMATION FOR A RADIAL PRINTING SYSTEM by Carl E. Youngberg et al., which claims the benefit of U.S. Provisional Application No. 60/191,317 filed Mar. 21, 2000, now U.S. Pat. No. 6,986,559, issued Jan. 17, 2006; and is related to U.S. patent application Ser. No. 09/873,010 filed Jun. 1, 2001, now published as U.S. Publication No. 2001/0035886 on Nov. 1, 2001, which is a continuation of U.S. Utility patent application Ser. No. 09/062,300, filed Apr. 17, 1998, now U.S. Pat. No. 6,264,295 issued Jul. 24, 2001, entitled RADIAL PRINTING SYSTEM AND METHODS by George L. Bradshaw et al.; which patents and patent applications are incorporated herein by reference in their entirety for all purposes.

BACKGROUND OF THE INVENTION

The present invention relates to apparatus and methods for printing or imaging onto spinning circular media, such as optical media. Certain embodiments of the present invention pertain to an off-radial-axis circular printing apparatus and methods that implement printing over a spinning media.

For the scope of the present invention, the terms "CD," "DVD" and "media" are intended to mean all varieties of optical recording devices that record media and their respective media discs, such as CD-R, CD-RW, DVD-R, DVD+R, DVD-RAM, DVD-RW, DVD+RW, Blu-ray, HD-DVD, digital versatile discs and the like.

In the art of decorating and labeling media as it applies to radial printing, there is a need to solve problems associated with using specific technologies for implementing printings, such as with a multiple nozzle array on an ink jet print head. To solve printing without distortion onto spinning circular media with a plurality of nozzle arrayed off the radial axis of the media, an apparatus and methods are needed to affect said printing. This said apparatus may be optionally configured to also record the said media, both within one insertion process, whereby the media is loaded or inserted only once into the disc drive, without removal, flipping and reinsertion, to affect printing the label and recording the media, serially or in tandem, prior to ejecting the media.

SUMMARY OF THE INVENTION

One embodiment of the present invention provides a method of printing within a rotating media. The method includes rotating the media at a selected rotation speed, providing a print head that is laterally displaced from a radial printing radius or not aligned along the radial printing radius, and printing within an annular print area. The annular print area may be defined by an inner hub circumference, two lines substantially parallel to the radial printing radius and tangential to the inner hub circumference, and an outer edge of the media. The system is configured to correct for distortion errors due to the laterally displaced print head to provide sufficient image and print quality.

In another embodiment, a plurality of the off-axis-radial printing devices according to the present invention, is stacked side by side in a rack or multiple racks. The off-axis-radial printing devices may also be stacked on top of each other. The plurality of the off-axis-radial printing devices may share a common controller and a media loading mechanism. Such a system may also be integrated to an automated manufacturing process for duplication manufacturing.

In another embodiment, the off-axis-radial printing device of the present invention is a standalone device that supports connectivity with a number of data source devices such as personal video recorders, portable music players, digital cameras, photo printers, televisions, and audio/video systems.

The standalone device may also support various input/output interface such as high-speed USB 2.0, USB hub, USB IDE/ATAPI bridge, USB devices, DMA transfers, Firewire, LAN, Ethernet, wireless, WIFI, and Bluetooth.

In another embodiment, the off-axis-radial printing device of the present invention is configured to be mounted onto an optical recording device. The printing device is configured to allow adjustment of frame mounts for front height and slide mounts for print head height. The printing device may be mounted horizontally or vertically to the optical recording device.

BRIEF DESCRIPTION OF THE DRAWINGS

FIG. 14 represents special commands to configure an off-axis-radial printing system in accordance with one embodiment of the present invention.

DETAILED DESCRIPTION

The present invention will now be described in detail with reference to embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
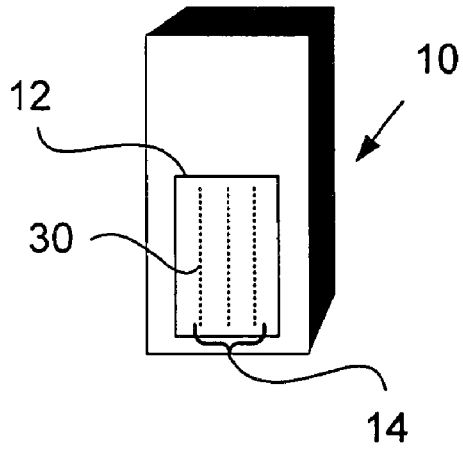
FIG. 1 is a diagrammatic representation of the bottom nozzle surface pattern of a conventional ink jet cartridge assembly.

Commercial ink jet print cartridges may be configured with elemental parts consisting of a body with an adjacent set of ink reservoirs for a plurality of colors and a plurality of nozzle plate. Each nozzle plate consists of arrays of individual nozzles, typically configured such that the nozzles are arranged in several rows or columns, usually in a parallel to one another. As shown in FIG. 1, print cartridge 10 has a body 11 configured with nozzle plate 12 and nozzle array 14, configured to be positioned near the surfaces to print. In ink jet technology, individual nozzles 30 are fired or portions of the arrays are fired when the nozzles are in the position to print. Typically, multiple nozzles are grouped and arrayed in parallel rows. This configuration as separate nozzle rows inherently create distortion of the image during radial printing, as taught by Bradshaw et al., in U.S. Pat. No. 6,264,295, which patent is incorporated herein by reference in its entirety for all purposes.

Figure 2:
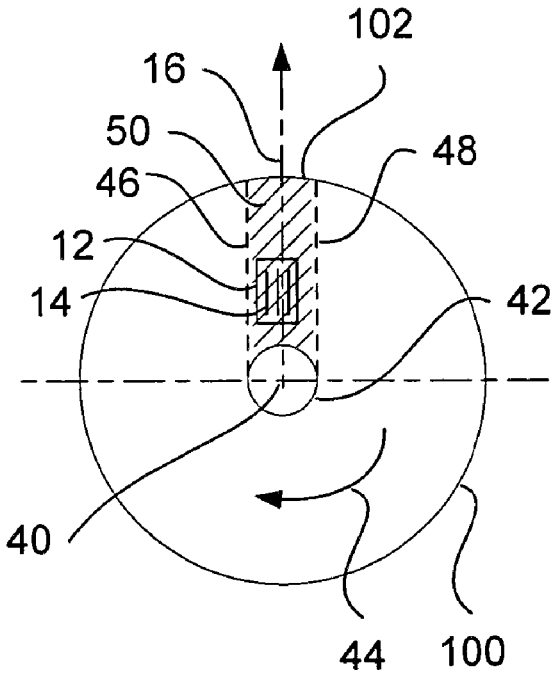
FIG. 2 is a diagrammatic representation of a print head with its nozzles positioned over an annular printing area.

By way of illustration, FIG. 2 shows media 100 centered at point of origin 40 with radial line 16 intersecting and originating from origin 40. Hub 42 may be used for mounting in a device when configured during spinning 44. When a radial printing system is configured to correct for distortion errors due to laterally displaced nozzle arrays 14, said nozzles that are aligned parallel to radius 16 may print anywhere within an annular print area 50 that may be circumscribed by (1) the inner hub 42 circumference; (2) two parallel to the radius lines 46 and 48, tangential to a points perpendicular to the radius on the hub circumference; and (3) the outer edge 102 of the media. The aforementioned method of printing within annular area 50 is termed "off-radial-axis circular printing," or simply "off-axis printing" as disclosed herein.

Figure 3:
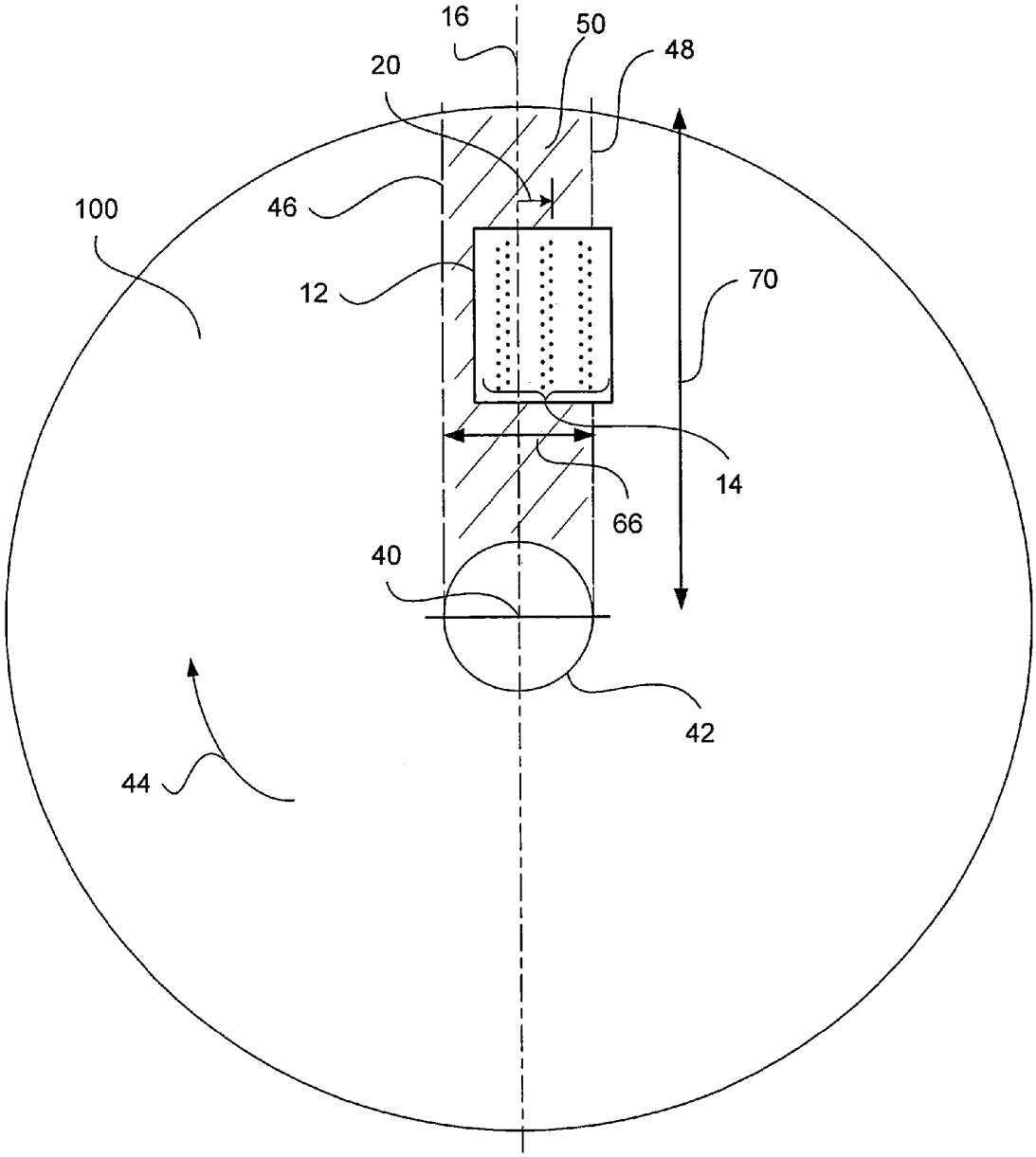
FIG. 3 is a diagrammatic representation of a nozzle plate from cartridge with radial line 16 arbitrarily configured to place radial line in the locale of and substantially parallel with nozzle array in accordance with one embodiment of the present invention.

In one embodiment of the present invention, referring to FIG. 3, off-axis printing may be performed by adjusting the lateral position 20 of each column element of the nozzle array 14 relative to the radius 16 so as to be positioned closer or further from the radius 16 or occasionally on the radius 16.

FIG. 3 illustrates nozzle plate 12 from cartridge 10 with radial line 16 arbitrarily configured to place radial line 16 in the locale of and substantially parallel with nozzle array 14. In general, this may be the normal configuration during operation of an off-axis circular printer. To print along an approximate radial locale, the distortions may be substantially corrected by using techniques disclosed in Bradshaw, et al., previously referenced, such that techniques disclosed therein to reduce large swatch, mismatch, twisting and dual conversion distortions—may also be substantially applied to off-radial-axis printing through off-axis mapping and a method herein called "progressive near-to-far-field off-radial-axis printing" approximations, or simply "near-field" or far-field" printing. Furthermore, these distortion reductions result in a substantially sufficient image quality as to acceptably print circular media labels. Thus, the off-axis radial printing may be affected by a series of mapping approximations, which vary by proximity to displacement 20 off the radial origin 16 axis.

Figure 11:
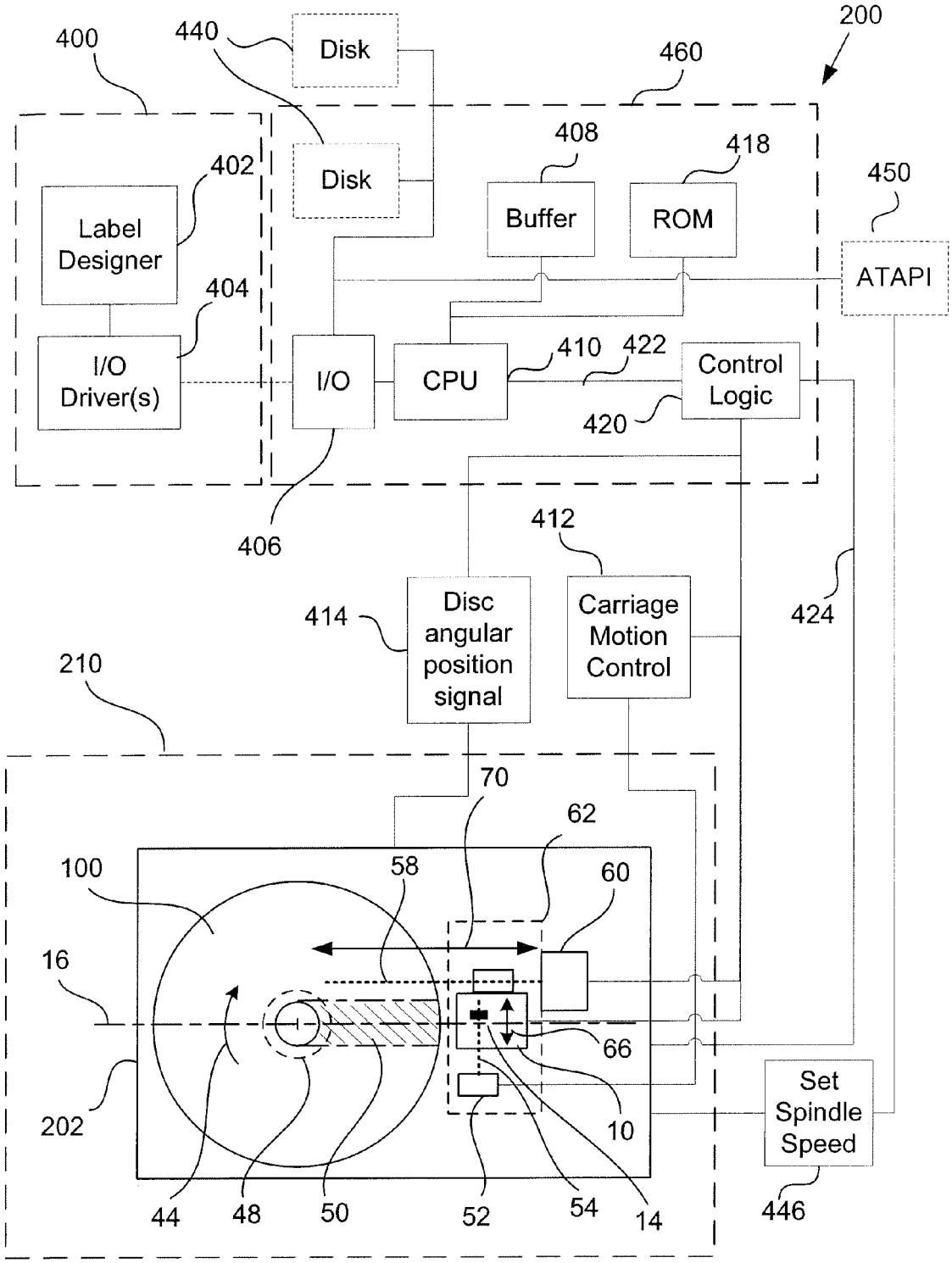
FIG. 11 is a block diagram showing mechanisms of one embodiment of the present invention.
Figure 12:
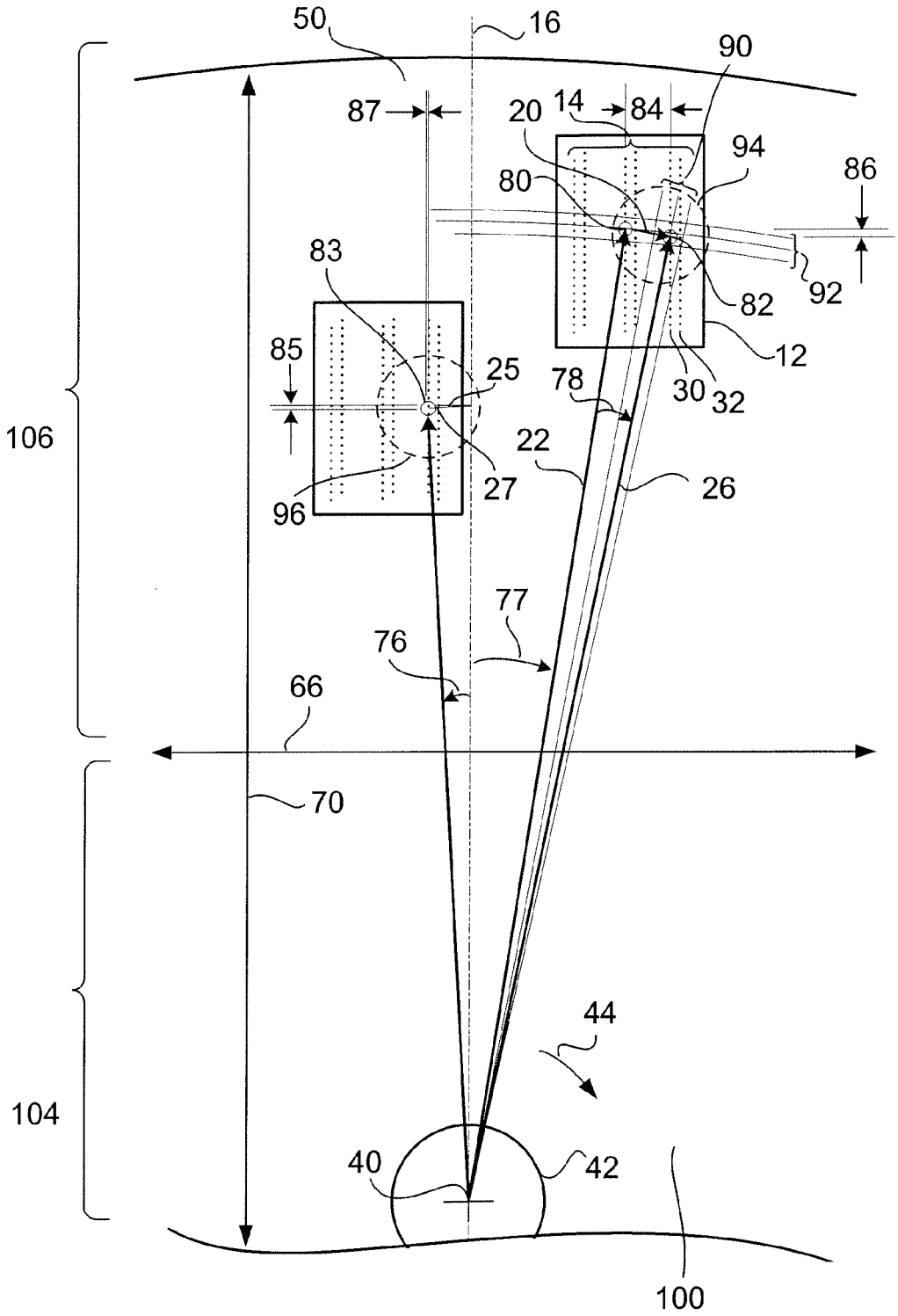
FIG. 12 is a diagrammatic representation of the bottom nozzle surface over a media including near fear and far field locus in accordance with one embodiment of present invention.

Referring to FIG. 12, off-axis annular print area 50 (FIG. 11) may be overlaid with the nozzle plate 12 footprint containing therein a plurality of individual nozzle columns 30 arranged in an a Cartesian-based grid array 14; and that said array of nozzles 14 may be mapped to a corresponding polar-domain-based grid (for this specific illustrative purposes in the locale of points 80.about.82), such that the Cartesian grid approximately or substantially intersects with a plurality of annularly spaced radial lines 90 extending from media origin 40 and a plurality of radially spaced annular rings 92 with the same origin 40 and extending from inner media edge 42 to the outer media edge 102. Further to this description, as print cartridge containing nozzle plate 12 with nozzles 14 moves radially along path 70 from the inner radial locale 104 of media 100 with inner edge 42 to outer radial locale 106 of media 100 with outer edge 102, the polar domain annular density progressively increases allowing for a higher correspondence of off-axis Cartesian point mappings. Similarly as print cartridge containing nozzle plate 12 with nozzles 14 moves perpendicularly along path 66 away from the locale of the radial origin line 16, the polar domain radial density progressively increases to allow a higher correspondence of off-axis Cartesian point mappings. A higher density along the annular, radial or both directions results in greater image quality and less mismatch distortion. In one embodiment of the present invention, approximately a 4000-count annular density 90 corresponds to a 300 dpi (dots per inch) Cartesian point mapping; approximately a 8000-count annular density 90 corresponds to a 600 dpi Cartesian point mapping; approximately a 16000-to-17000-count annular density 90 corresponds to a 600 dpi; and so on, as may be extrapolated to higher or to lower dot densities.

Along the radial polar axis, radial ring density 92 center on origin 40 may likewise be adjusted correspondingly and directly articulated with the preferred embodiment of the present invention operably by actuation of radial stepper motor 60 and lead screw 58 (FIG. 11), which lead screw is configured with a pitch such each step of the motor corresponds to the Cartesian grid of 600 dpi or any partial or multiple thereof, to achieve said corresponding radial densities in 300, 600, 1200 dpi and higher or lower resolutions. For example to achieve a higher than 600 dpi ring density 92, when lead screw 58 and motor 60 are configured for 600 dpi, a fixed multiple thereof may be affected by configuring the firmware to micro-step the stepper motor in half, quarter, or smaller increments, thus affecting 1200, 2400 and higher radial resolutions.

Figure 9:
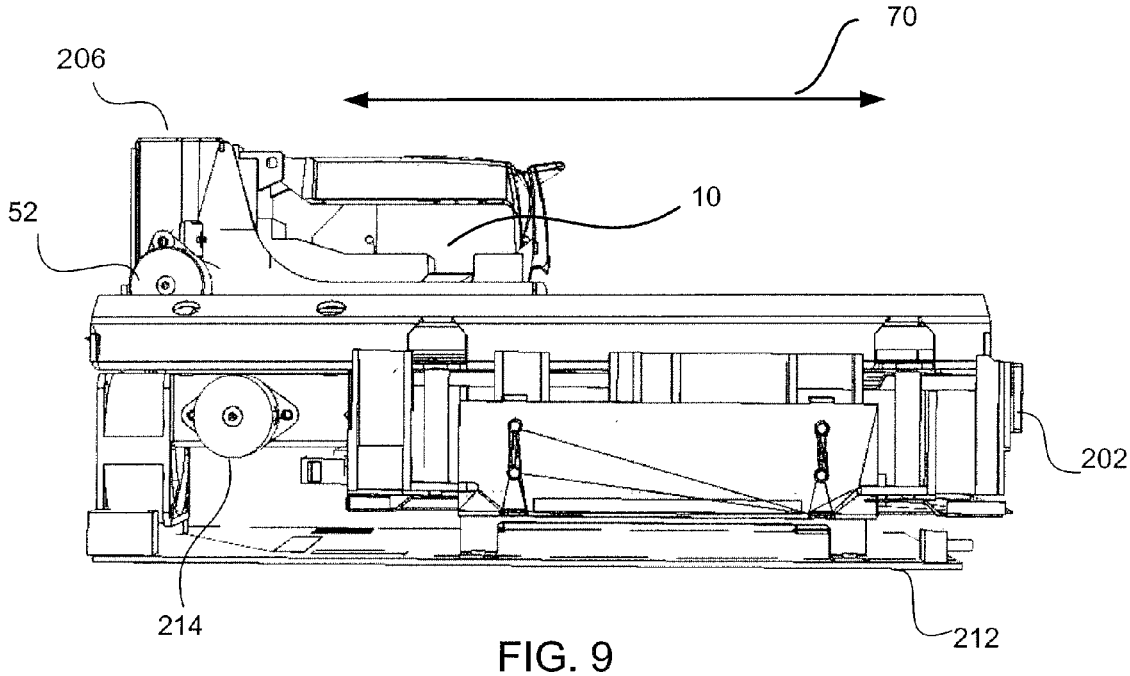
FIG. 9 is another diagrammatic view of an off-axis-radial printing system in accordance with one embodiment of the present invention.

Using the above techniques in embodiments of the present invention, annular density 90 and radial ring density 92 (FIG. 12) may be set independently at different resolutions to achieve the desired printing quality effects. In one configuration the image may appear better looking with annular print density at a higher or lower density than the radial ring density 92. For example, device 200 may be configured with lower-cost components to actuate the radial polar axis at 600 dpi while yet maintaining effectively adequate resolution for acceptable printing in the annular direction of 1200 dpi. Similarly, the opposite different use of resolutions along the annular density 90 and radial ring density 92, respectively, may be used to lower the cost of the rotation spindle motor assembly and thereby reduce the cost of disc drive 202 (FIG. 9). Thus, the resolution may be configured independently for the two polar axes in the device 200 to achieve a wide variety of desired configurations with resultant printing results.

As these and similar Cartesian-based equivalent mappings allow integration of standard ink jet print cartridges 10 such as from manufacturers like Lexmark, Hewlett Packard, Olivetti, Canon, Epson and the like, as used in the present invention, the off-axis mapping technique may reduce costs. Similarly this method may be applied to commercial-grade, larger format print heads from manufacturers such as Xaar Xaar of Cambridge, UK, the Spectra division of Dimatix of Lebanon, N.H. and similar, when configured in multiple Cartesian arrays of nozzles over circular spinning media.

First by way of illustration of far-field printing on a single print position 80 among the plurality of all print positions, refer again to FIG. 12, where far-field locus 94 represents a subset of polar grid lines comprising a plurality of annular radii 90 and radial rings 92 intersecting in the proximity of print position 80, displaced perpendicularly off radius 26 by amount 20 and annularly at angle 78 from radius 26. Depending on the configuration, print head nozzle plate 12 may or may not intersect radius 26 and depending upon the desired print resolution, print position point 80 may or may not exactly intersect at corresponding intersecting polar grid lines 90.about.92. If point 80 intersects, then the control system 460 (FIG. 11) fires the appropriate nozzle jet to directly discharge ink at that position. If not, then using a nearby location 82 and correcting for annular 84 and radial 86 offsets, an approximation may be made. Due to the nature of radial printing whereby the media continuously rotates 100 while the print head 10 may hover adjacently overhead and discharge ink objects at an optimal time, as disclosed in Bradshaw et al. and also by Jones et al. (who are among the present inventors) using interleaved radial printing, previously referenced (U.S. Pat. No. 6,786,563), a plurality of opportunities are available when to print point 80. As such, an adjustment may be made along the radial polar axis 16 by moving the print head 10 (FIG. 11) outward or inward, while in tandem, an adjustment may be made along the annular axis (one of the set in 92) to angle 78 by adjusting the time when the particular ink jet nozzle is discharged. This ability for the print head to hover over the media and print on a first followed by a plurality of subsequent revolutions effectively enables off-axis-radial printing, since for any given radius, a plurality of angles are available for use depending upon the print head nozzle firing timing. Furthermore, these angles may be at a higher that the desired print resolution to provide a plurality of more opportunities to print at any given radius.

Further approximation may be used with nozzle pairs or close parallel groups, such as 30.about.32. To enhance print resolution along column directions, common print head 10 (FIG. 11) nozzle plates 12 are configured to arrange nozzles in pairs of alternating dot rows usually due to a limitation in the particular construction of the nozzle plate, as illustrated in FIG. 3. Thus if the dot density of column 30 is 300 dpi, then companion column 32 is usually also 300 dpi, displaced along column directions of the nozzles by half the difference, or 1/600 inch, yielding an effective column pair dot pitch of 1/600 inch. The assumption and approximations used herein for off-axis radial printing may similarly be used with column pairs. Furthermore, if the distance between column pairs is minuscule, the same assumption may apply for on as the other, depending upon the radial displacement from the media origin 40. The further from media origin 40 and the closer to the radial origin 16, the better this assumption holds true. In other words, often the column couplet 30.about.32 may be treated as a single column.

In another embodiment, the print head other than ink jet printing, may similarly be configured off-radial axis using this hovering technique, such as with a laser or an array of lasers or a thermal film transfer array as the print head. Similarly this method may be employed to compensate for the where and when to fire a laser for off-radial-axis point-on incidence ink curing, for example, as disclosed by Unter, previously referenced (U.S. Pat. No. 6,854,841).

As a detailed example for use with ink jet printing, this following sequence may be used to select an approximate point 82 within locus 94 of point 80 to print, as illustrated in FIG. 12:

First, point 80 is chosen to print from among points in a Cartesian image at a given radius 22.

Second, convert point 80 into its polar equivalent (r, Θ) from among a plurality of the set of all radii and angles in the polar domain grid 90~92 by methods disclosed in Bradshaw et al previously referenced.

Third, chose the closest radial point from among the plurality of nozzles in column 30 offset by 20 from radius 26. This approximates a right triangle, so the Pythagorean theorem and since offset 20 subtends angle 78, the arctangent of the offset over the radius 26 may be used to computer offset angle 78.

Fourth, using offset angle 78 to map to a new polar point 82, calculate the total offset as the sum of the offset angle 78 and the angle 77 off the radial origin 16.

Finally, using nearest neighbor or a nearest neighboring nozzle that may coincide with the present or a subsequent angle set 90 during a subsequent rotation, select it to print.

In the near-field printing around locus 96, wherein offsets 25 and 27 are nearly equal, point 83 is so near to radial origin 16 that an approximation may be made to ignore either or both annular 87 and radial 85 displacements and thereby use angle 76 directly as the angle to select point 83 to print.

Figure 4:
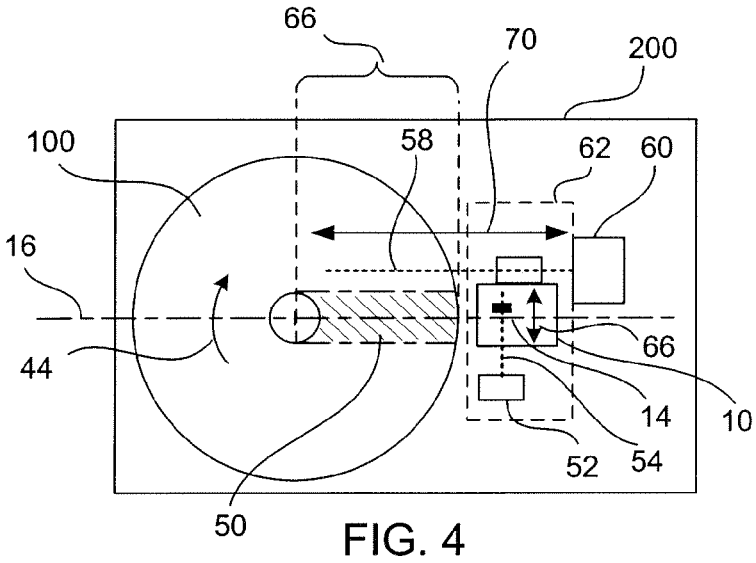
FIG. 4*a* is a diagrammatic representation of a combination device consisting of a device and off-axis-radial printing system of the present invention showing a parallel motion profile, with the lateral component moving perpendicular to the nozzle columns.
FIG. 4*b* is a diagrammatic representation showing a sinusoidal motion profile, created by moving the parallel and lateral motion actuators in concern to create a randomizing aggregate nozzle array motion component.
FIG. 4*c* is a diagrammatic representation showing a gradual curving profile from inner to outer radii, which results in a gradient from lower to higher radial print density when going from inner to outer radii.
Figure 4B:
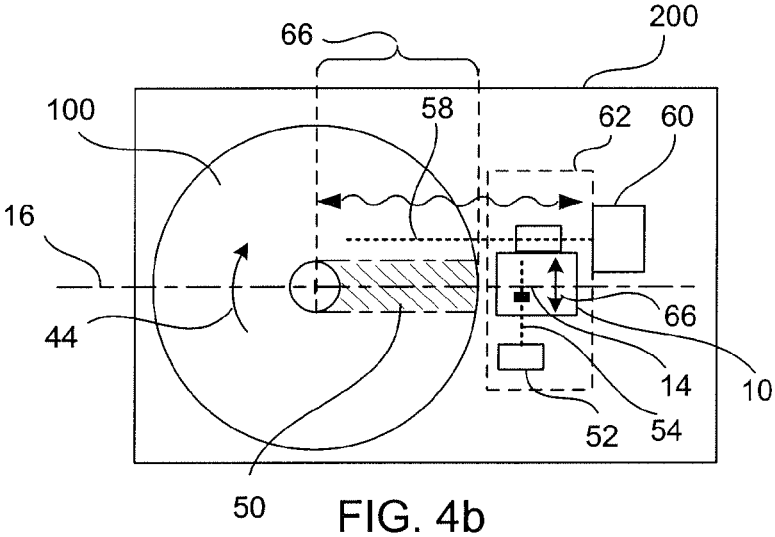
Figure 4C:
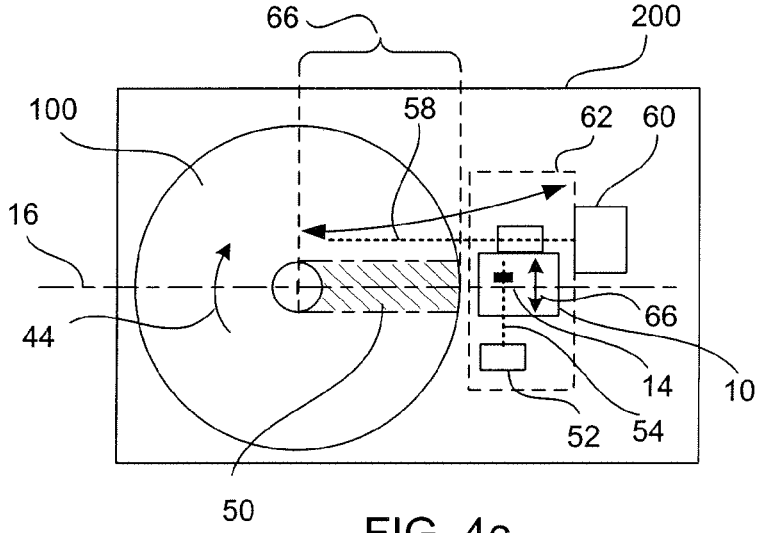

In one embodiment, nozzle array 14 may be configured to be operably positioned two dimensionally, both parallel 70 to the radial direction and perpendicular (or lateral) 66 to the radial direction. Such a configuration allows placement of the nozzle array substantially inside of print area 50 (FIG. 12). To compute the individual nozzle or column of nozzle to discharge a printing object, such as an ink jet droplet, the differential nozzle column offset 20 is computed from the lateral 66 motion axis. Referring also to FIG. 4, the lateral offset 20 may be actuated by a stepper motor 52 (FIG. 4) and lead screw 54. Along the radial parallel direction 70, an off-axis circular printer may be configured to operably move, actuated by a stepper motor 60 and lead screw 58. By combining the motion of both the parallel 60 and lateral 52 actuators, a plurality of motion profiles may be used to affect the best print quality vs. performance. FIG. 4 shows a parallel motion profile, with the lateral component moving perpendicular to the nozzle columns. FIG. 4*a* shows a sinusoidal motion profile, created by moving the parallel and lateral motion actuators in concern to create a randomizing aggregate nozzle array motion component. FIG. 4*c* shows a gradual curving profile from inner to outer radii, which results in a gradient from lower to higher radial print density when going from inner to outer radii. Of course, these examples are representative of a plurality of possibilities when both actuators are used in tandem to position the nozzle arrays most advantageously for the printing effect or improvements desired. In these cases the printing may be constrained by the physical limits of the actuators to be within print area 50.

Figure 6:
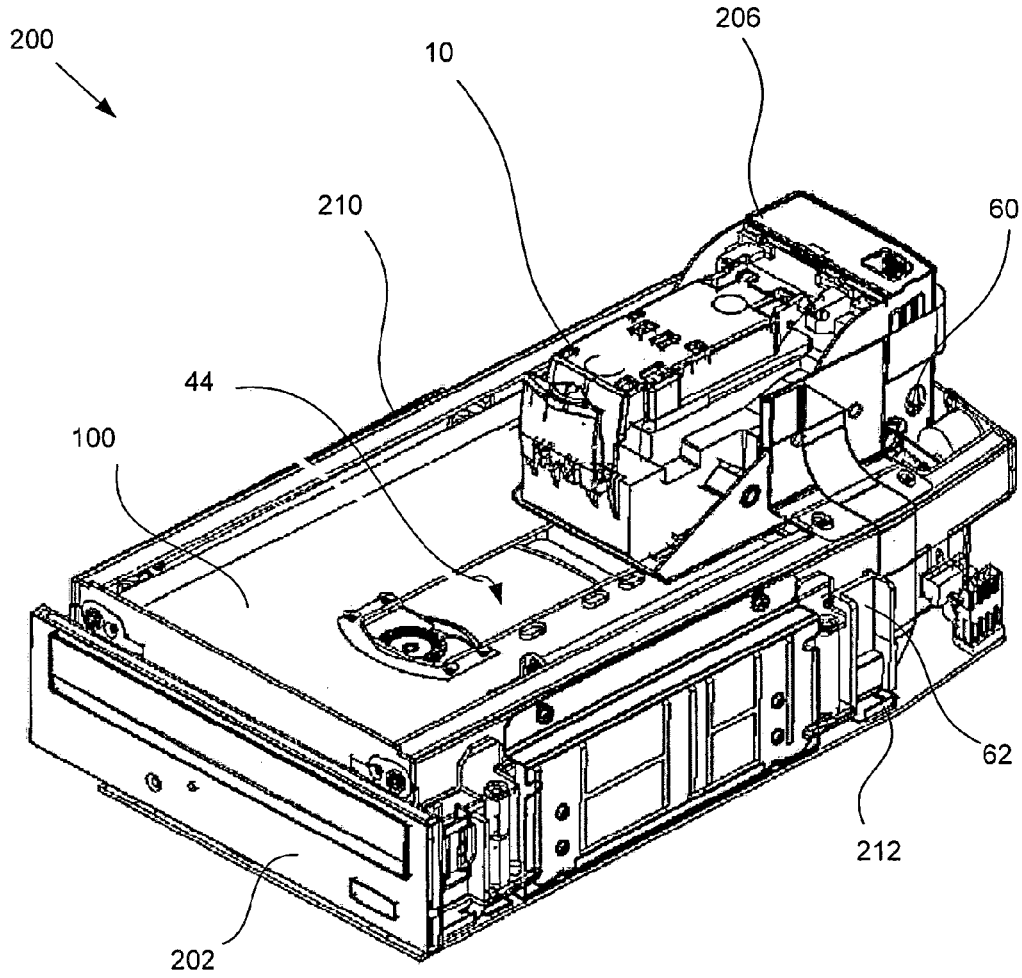
FIG. 6 is a diagrammatic top view of an off-axis-radial printing system in accordance with one embodiment of the present invention.
Figure 7:
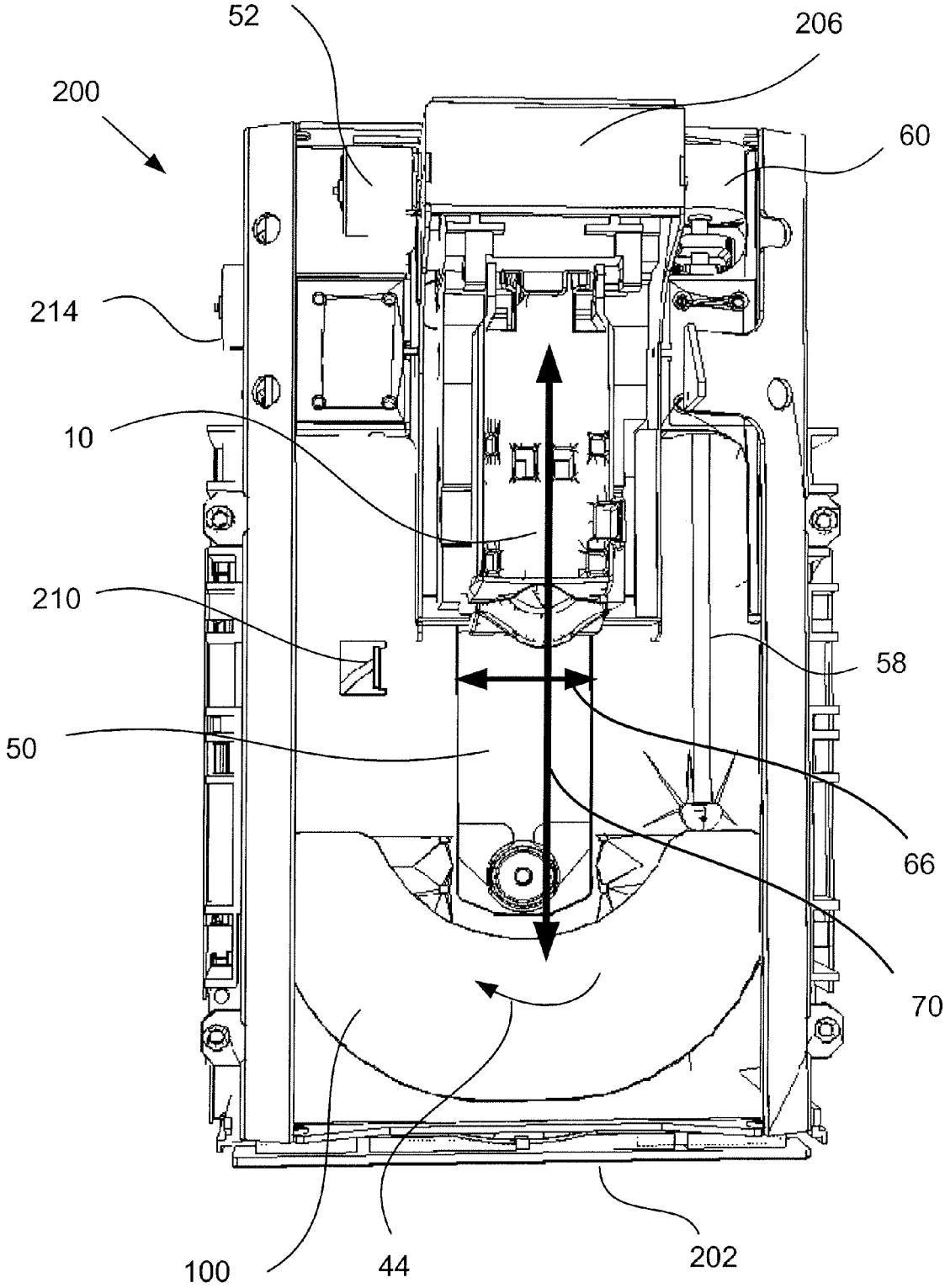
FIG. 7 is another diagrammatic view of an off-axis-radial printing system in accordance with one embodiment of the present invention.
Figure 8:
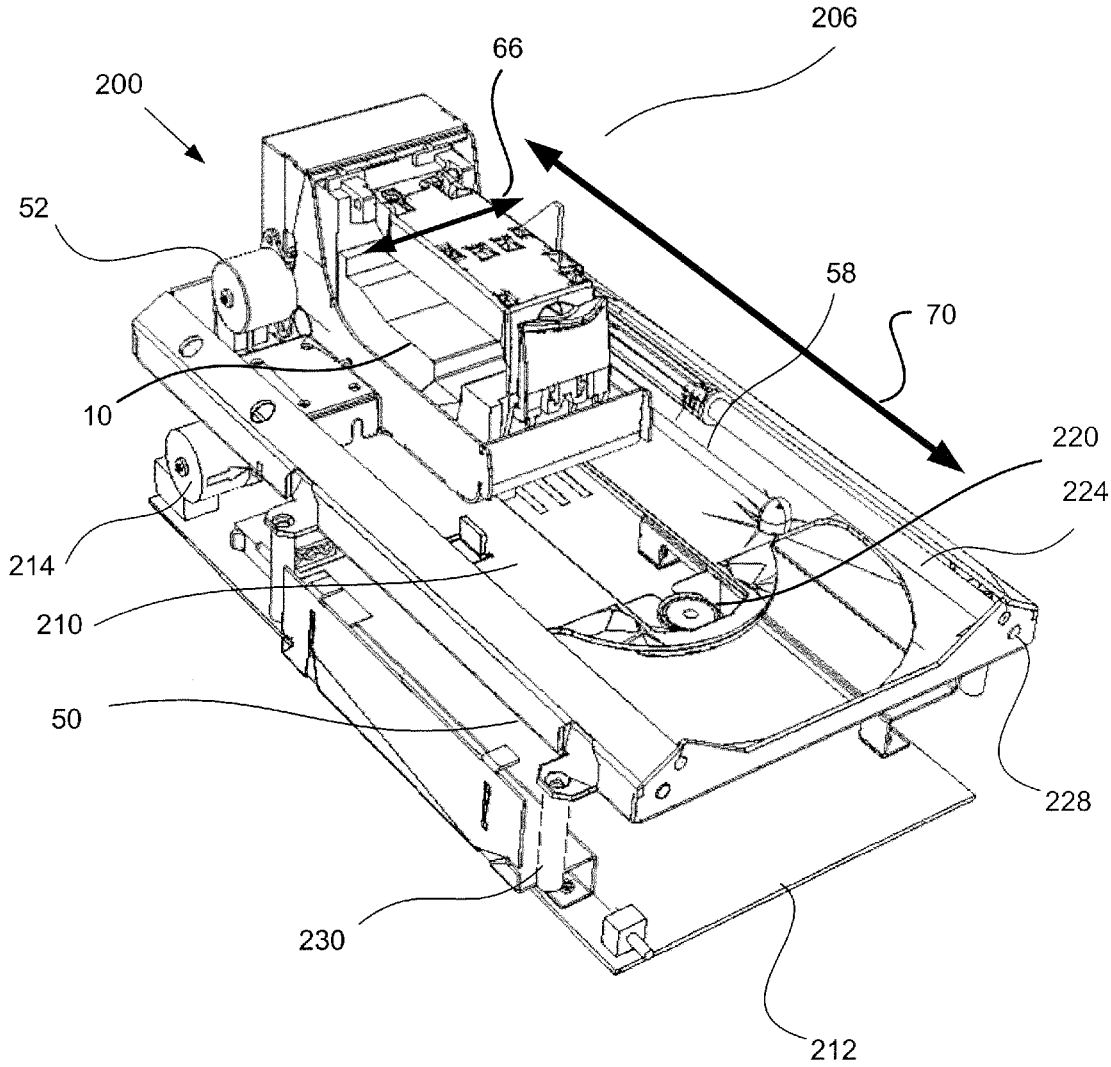
FIG. 8 is a diagrammatic side view of an off-axis-radial printing system in accordance with one embodiment of the present invention.

FIG. 6.about.15 illustrate embodiments of the present invention. FIG. 6 shows a perspective view of an off-axis circular printer configured with a disc drive 202 under an off-axis printer assembly 210, with carriage assembly 206 holding print cartridge 10 mounted over media 100 installed in said disc drive. As disc drive 202 spins, parallel stepper motor 60 through lead screw operably engages with and moves carnage assembly along path 70 (FIG. 12) so as to be substantially in relative position over the media, while lateral stepper motor positions nozzle array elements to their respective positions substantially along path 66 (FIG. 12).

Figure 5:
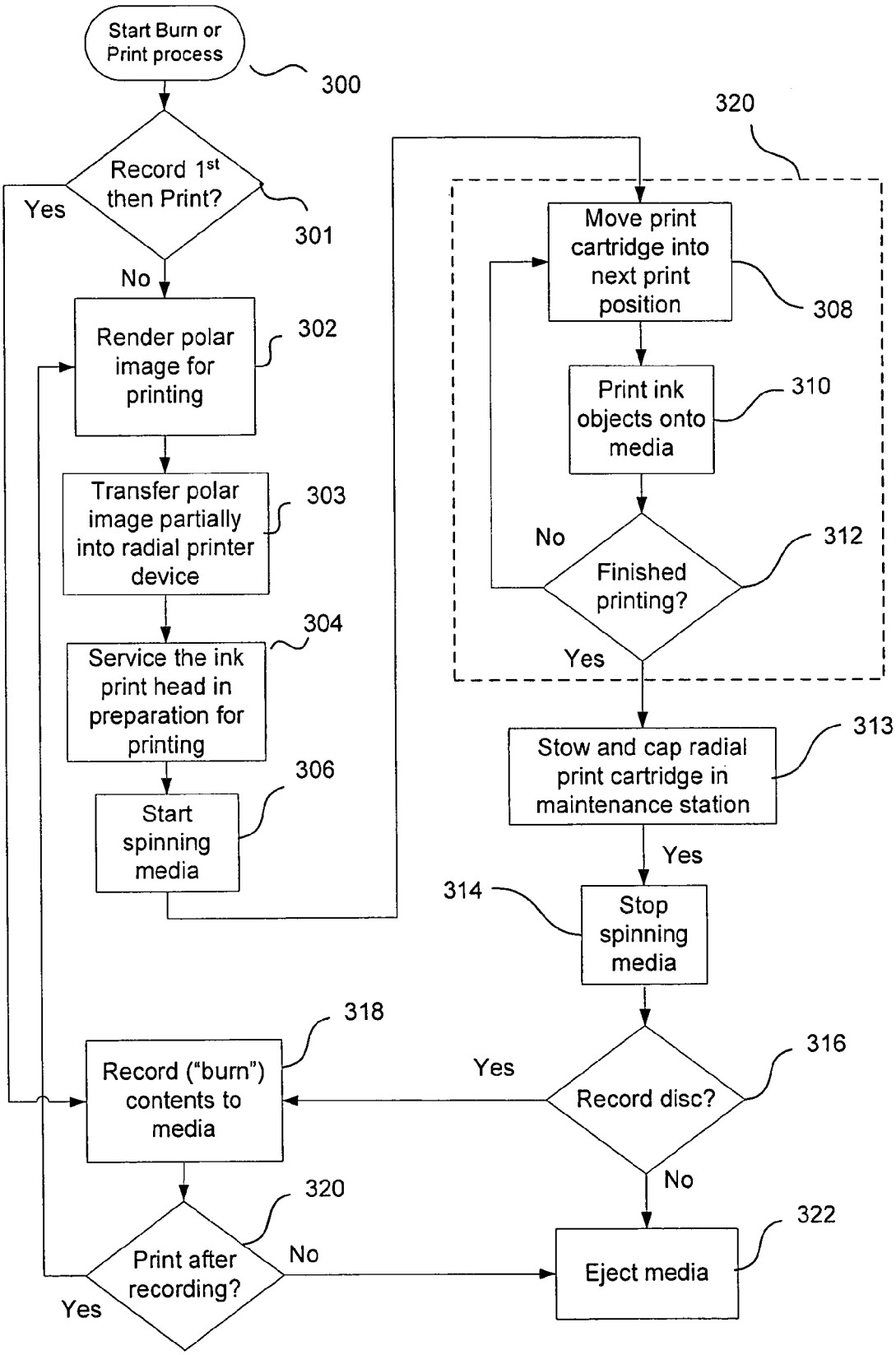
FIG. 5 is a flowchart of the off-axis-radial print system in accordance with one embodiment of the present invention.
Figure 10:
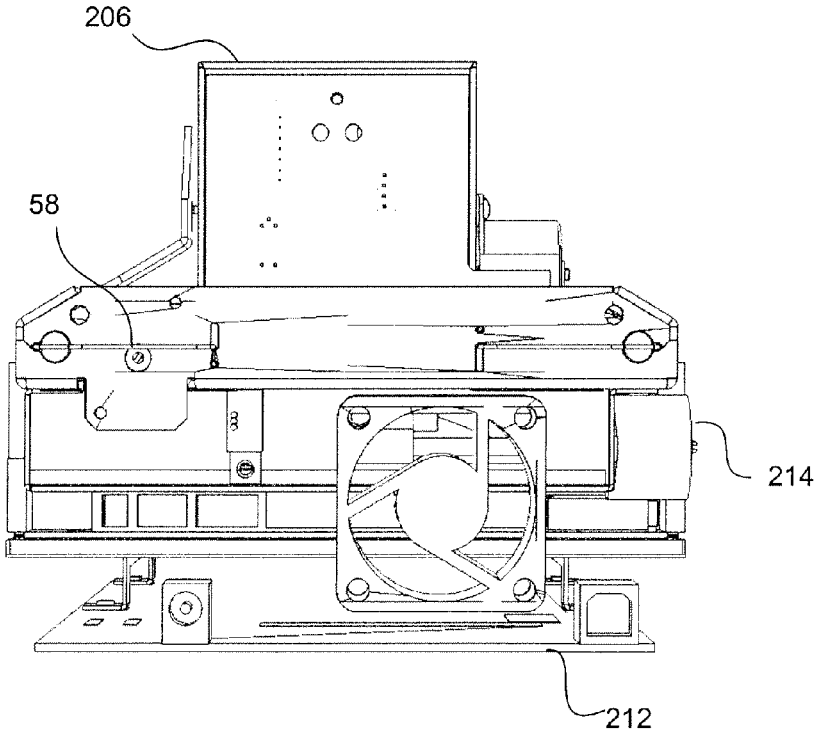
FIG. 10 is another diagrammatic view of an off-axis-radial printing system in accordance with one embodiment of the present invention.

In an embodiment of the present invention, the novel process that may be used during operation of the off-axis circular printer 200 ("device", FIG. 4) is illustrated in the flow chart in FIG. 5. wherein media 100 (FIG. 4) may be burned and printed in a single insertion of the media. The user initiates the printing process 300 and determines 301 whether to either first print, and then burn the media with data, or the reverse sequence. In either case, when device 200 is configured with a disc drive 202 to burn and print without removing the media in between these two processes, herein termed a "single insertion." If printing first, the user prepares the label to be printed using label designer 402 (FIG. 11) such as SureThing by Microvision Development of Carlsbad, Calif. on the host computer 400, which prints the label to the off-axis radial printer drive 404 that renders the polar image 302; then transfers the polar-rendered print image 303 to the device 200; whereupon device 200 prepares the device print head 10 for printing by performing servicing 304 through the use of the print cartridge maintenance station (explained later in the present invention and illustrated in FIG. 15). The print driver 404 may the configured with a status monitor to activate drive 202 with special commands shown in FIG. 14; this starts drive 202 spinning 306 at customer spin rates for printing; the device 200 moves print head 10 into a first position 308 over spinning media 100 and prints 310; whereupon, a plurality to print positions are cycled though 320 until finished 312; print head 10 is returned 313 to the maintenance station 62 (FIG. 10); the drive is commanded to stop spinning 314; if the media is also being recorded 316, the disc is burned 318 with digital content by burning software, such as RecordNow from Sonic Solutions of Navato, Calif., and media 100 upon completion 320 is ejected 322. All of these processes between step 300.about.322 may be accomplished within a single insertion of the media 100.

Referring again to FIG. 5, if burning data first, following inserting media 100 into device 200, first proceed directly to step 318 to record the content, then proceed through printing as above following steps 302~316, and finish with ejecting the disc 322; again all may be accomplished within a single insertion of the media 100.

By way of the specific configuration of the device 200, during the process of printing, label designer 402 (FIG. 11) sends out the print job via drivers 404 to the device 200 control system 460. This control system 460 may have elements to perform I/O 406 with the host, a CPU 410 to manage operations, buffers 408 to receive and hold data via higher speed 110, such as DMA, ROM 418 to hold firmware, and Control Logic 420 in the form of an FPGA or ASIC to assist the CPU 410 in controlling the system electronics which may be on the main PCB assembly 212 (FIG. 10), disc drive 202, print cartridge 10 and carriage motion 412. Disc drive 202 may be configured to be installed adjacent, relative to or under the printer assembly 210. In an embodiment of the present invention, CPU 410, Control Logic 420, buffers 408, I/O 406 such as DMA, ROM 418, ATAPI drive interface 450, Carriage Motion Control 412, Disc angular position signal 414 and Set Spindle Speed 446 may in any combination, be configured into a single System-on-a-Chip (SoC) ASIC, or into a reduced number of chips, to reduce overall size or to improve system performance.

In an embodiment of the present invention, the disc drive's firmware may be configured with customized firmware to receive customized commands that spin the drive relatively slowly under the normal drive functional spin rates to approximately 400-500 rpm, turn the spindle motor 48 on, off, eject the tray and move the laser OPU (optical power unit) to a position other than the drive home position to allow safely servicing the cartridge and clearing media or debris from the printing area. For example as illustrated in FIG. 14, these customized commands may be in the form of special ATAPI commands, in command block 500 bit-array and corresponding response block 520 bit-array. In typical use, these commands may be issued to the drive via its physical interface using the ATAPI protocol. For example, the drive may be controlled by the operating system using standard ATAPI commands (not shown in FIG. 14) to reserve the drive for exclusive use, limiting interference by other processes, and lock the tray-eject buttons from the user. The command block 500 is subsequently populated with bit settings 502.about.516 per instructions 550.about.560, and sent by ATAPI command to the drive. The status response block 520 is returned by drive in status bits 522 (byte 2, bits 0-4) with values 562. For example, to turn on spindle motor 48 at 400 rpm, bits 504, rotate speed, may be set via command 554 to value 001b (001 binary) along with bits 502, spindle servo (58), via command 552 set to Gb. Responding to status command 560 set in bit 512, the drive returns status bits 522 in response block 520, which may be interpreted as status values 562, to check whether the drive has assumed this slower mode. When finished printing, the drive may be sent the spindle servo command 552, value 0b, to return the drive to normal operations. Then the drive buttons are unlocked and the drive is released for use by the operating system.

Other ancillary commands in 552 may be used to control other aspects of the drive for configuring an off-axis printer. For example, because the top of the drive may be removed to allow direct printing access to the CD, and the optical power unit sled holding the laser may home near the center of the media, the laser may be exposed to physical damage or potentially expose the user's eye to the laser output; thus it may configured to move 556 inward or outward 558 to place it out of harms way during servicing the print cartridge. In another example, the drive spindle speed may be optionally set 554 to approximately 500 rpm during printing or the drive may be reset 514 back to default settings. Similarly, other commands may be added to the reserved 516 bits and status response 562 to enhance future functionality of the drive for use in off-axis printing apparatuses. In another embodiment of the present invention, the ATAPI commands may be included or abstracted as part of a more comprehensive off-axis printer language, such as off-axis radial print language ("ORPL"), such that functions like printing, status, rendering and other commands may also be included therein. For example, referring again to FIG. 11, the off-axis printer's firmware in ROM 418 may include an interpreter to parse these ORPL commands, optionally generate status or progress response message back to the host 400 through I/O 406 and directly render a Cartesian image from the host 400 into a polar image, corrected for off-axis radial printing 302 (FIG. 5), and into the radial print stream 422 for processing by the control logic 420 and streaming 424 to the off-axis printer 200. Similar processes may also be performed without a host, as earlier described, but wherein the ORPL may be used internally to the 460 to queue up jobs or process them sequentially to a buffer 408 or to an optional disk drive 440. The off-axis printer 200 may be configured with a plurality of disk drives 440 that are either attached internal or external it, and may be a standard type of IDE hard drive, solid-state drive or Flash-memory disk drive, compatible with the varieties of I/O 406 previously described in the present invention. When alternately configured with an external hard drive 440, it may be configured with a stand-alone hard drive 440 or interfaced to a hard disk drive in an externally attached PVR, as previously described in the present invention, or it may be configured with a removable disk, USB drive or the like.

In another embodiment of the present invention, the off-axis printer 200 may be configured to spin the media at rates lower than approximately 400-500 rpm, by configuring the drive with a custom spindle motor 48 configured with an encoder and the motor designed to run without cogging at slower speed, as slowly as under 100 rpm, by employing the techniques disclosed by Youngberg et al., (U.S. Pat. No. 6,986,559), previously referenced and which patent is incorporated herein by reference in its entirety for all purposes.

In another embodiment of the present invention, the off-axis printer 200 may be configured to spin the media at rates higher than approximately 400-500 rpm, and among other techniques, to reduce image distortion as disclosed by Bradshaw et al. (U.S. Pat. No. 6,264,295), previously referenced, as well as employ point-of-incidence ink curing techniques disclosed by Unter, (U.S. Pat. No. 6,854,841), previously referenced, which patents are incorporated herein by reference in its entirety for all purposes.

In another embodiment of the present invention, a shield (not illustrated) may be configured over the OPU's laser to operably move out of the way during printing and return afterwards, to prevent exposure to debris. This shield may optionally be configured with a safety interlock device to prevent potential laser exposure to the user's eye. The shield may be configured with a sensor interfaced to the control system 460 to determine the state of closure and fashioned from materials in a substantially rigid form, such as from metal, plastic or the like, and operably pivot, slide or move out of the way during printing, and return automatically via a spring, actuator or motor when the print cartridge 10 returns back into the maintenance station 62. Drivers 404 coordinate activities between the print spooler subsystem and the mass storage subsystems to reserve the drive so that said custom firmware commands may be issued to the drive for exclusive use with printing. Disc 202 may be a Plextor 716A DVD+/−R or newer model drive that has been configured to have annular motor position signals as disclosed in U.S. Pat. No. 6,736,475 by Youngberg et al., which patent is incorporated herein by reference in its entirety for all purposes. Alternately a Teac DVW28E or any drive manufacturer's model similarly configured may be used. These annular motor position signal outputs may be physically coupled to outputs on an unused pin of the IDE or Audio output cables assemblies, or may also be configured for output in any similar or customized physical connector or manner as determined by the drive manufacturer, which is compatible with control system 460.

Figure 15:
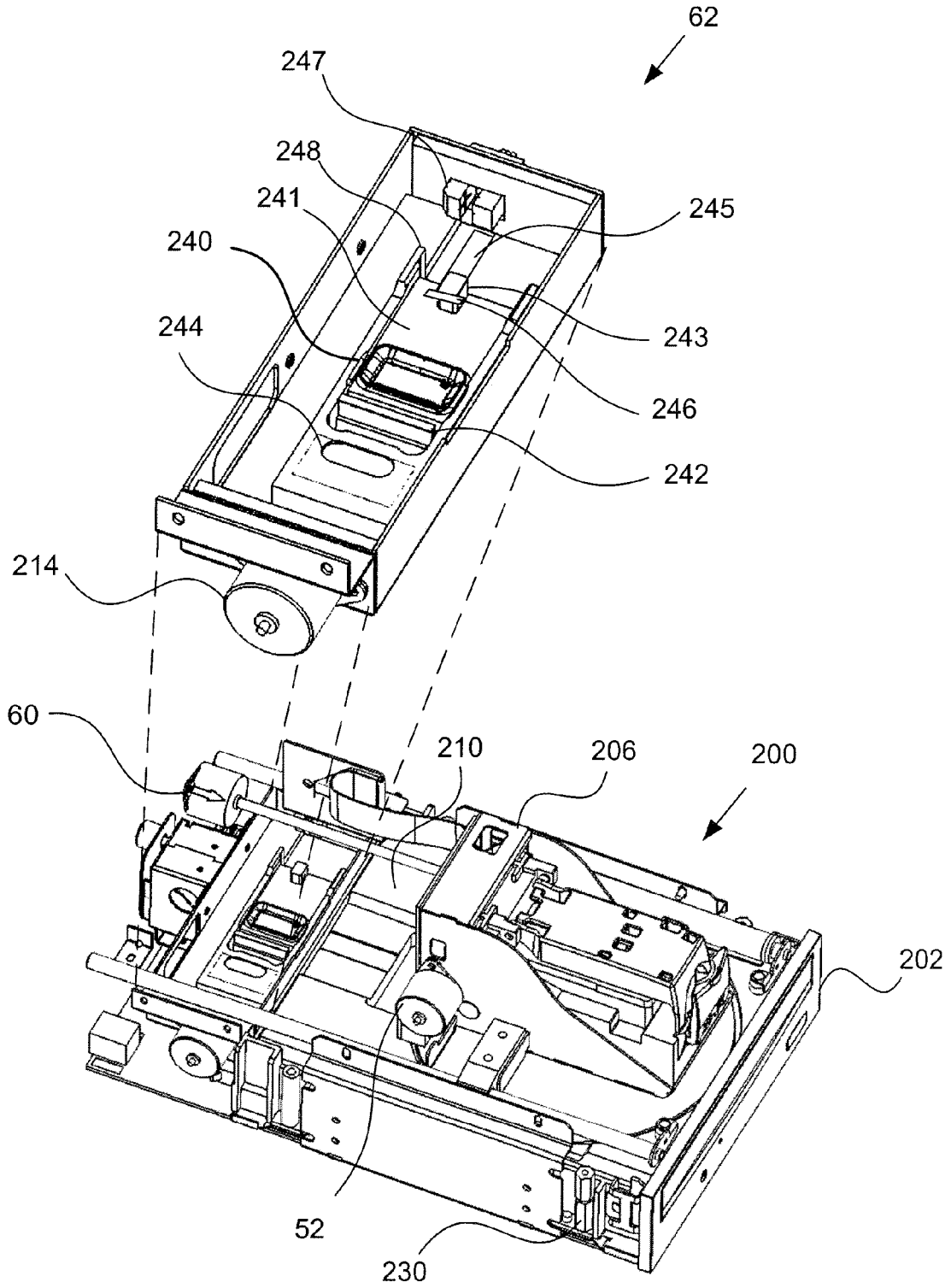
FIG. 15 is a diagrammatic view of an off-axis-radial printing system and cartridge maintenance station in accordance with one embodiment of the present invention.

As illustrated in FIGS. 3, 4, 11, 12, and 15, print cartridge maintenance station 62, as illustrated in FIG. 15, for a device 200 configured for using ink jet technology, may be configured relative to the print cartridge carriage assembly 206 in position behind drive 202 and under the print assembly, such that it may operably move by the use of motor 214 laterally 66 to the radial carriage motion 70. By so configuring in a operable sled 241, wiper 242 is mounted substantially parallel to the carriage 70 and substantially perpendicular to the nozzle plate array 14 so that during use, motor 214 moves to uncap 240 the cartridge nozzles 14 and moves a wiper 242 to sweep across the nozzle surface 14, then positions a spittoon 244 under the nozzle arrays 14 for nozzle flushing prior to printing. The cap 240 is mounted to the sled 241 with an articulated carriage to allow it to move upward and downward, with a spring-loaded return. When capped, it is in the upward position, so it seals against nozzle plate 12, so caused when the sled 241 is fully retracted towards motor 214, such that peg 243 is pressed against stop 246. During printing, sled 241 moves away from motor 214 releasing peg 243 from stop 246 and allowing cap 240 to retract downward, thereby unsealing the nozzle. Sled progresses away from motor 214 with peg 243 guided along slot 245 until flag 248 attached to sled 241 trips sensor 247. During transit, wiper 242 sweeps across the nozzles 14 and nozzle plate 12 surface, then comes to rest when sensor 247 trips 241 to position spittoon 244 under the nozzle arrays 14 for nozzle flushing prior to printing. In this configuration, spittoon 244 is prepositioned at the "home" radial start position, inline with radial origin axis 16, optimizing overall design and operation of the printhead carriage 206 motion. The maintenance sled 241 remains in this position throughout printing. When printing is finished, the motor 214 causes sled 241 to move to the position between just after the wiping position (without wiping the nozzle) and prior to the cap rising, whereupon the cartridge carriage assembly 206 is returned to "home" position, and then motor 214 causes the sled 214 to recaps the nozzle plate 12. This configuration and methodology assures proper operations of a Lexmark print cartridge; however, the configuration may be altered to optimize ink jet maintenance servicing for other configurations or brands as may be needed. Cartridge carriage assembly 206 may be configured to move radially 70 and laterally 66 to assist in this process as needed for optimization and for all other uses. Upon completion of the overall printing process, the carriage assembly 206 is returned to position the nozzle arrays into radial and lateral alignment with the maintenance capping station 240, where upon the nozzles are capped to prevent dehydration or potential clogging until next use.

In an alternative embodiment of the present invention, the maintenance station 62 may be configured on side, above or behind drive 202, relative to pen carriage 206. The print carriage 206 may be configured to tilt or rotate, for example up to 90 degrees, around travel axis 70 to mate with the maintenance station 62 mounted above, to the side or to the rear of the media. The pen carriage 206 may be alternately configured to hop up to or relative to a maintenance station 62 on a parallel plane above or relative to the travel path axis 70, thereby allowing a configuration with less overall depth and smaller size. In this case, the pen carriage 206 may be configured with parallelogram linkage assemblies or actuators to translate the pen carriage to the alternative plan to mate with the maintenance station. Alternately the maintenance station 62 may be configured to traverse to the print carriage relative to the printer assembly 210 frame. Alternately the entire device 200 may be configured to operate on its side, angled or upside down, wherein such configurations would place the maintenance the similarly but relative to the and pen carriage 206 and its travel path axis 70.

Figure 13:
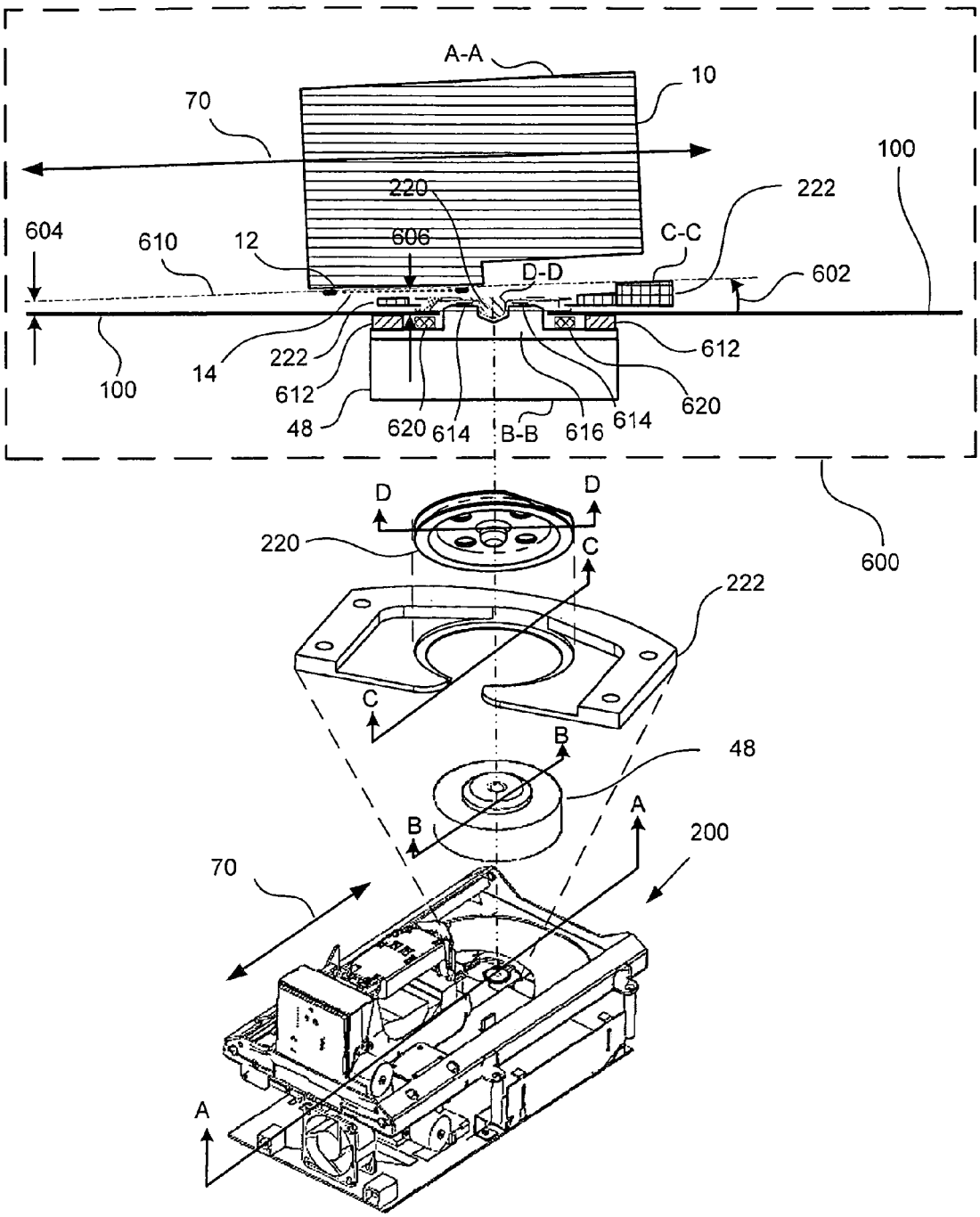
FIG. 13 is another diagrammatic view of an off-axis-radial printing system in accordance with one embodiment of the present invention.

Print assemble 210 may be configured with a slim keeper assembly 220, as illustrated in FIG. 13 and more particularly in cross-section 600 therein, depicting the hub clamping and relative print cartridge alignment to the slim keeper assembly. Cross-section 600 is a composite cross-section of A-A through the printing carriage and print cartridge parallel to the radial pathway 70 of device 200, B-B thought the drive spindle motor 48, C-C through the keeper bridge 222 and D-D through the slim keeper 220. This keeper is configured to be slim enough such that the bottom of the print cartridge body will fit over the keeper 220 when moved along path 70 from the outermost to the innermost radius for printing and to change the cartridge. The keeper 220 is of such a design and of magnetically conductive materials to allow automatically chucking the media under normal insert of the drive tray. Drive chuck hub 616 may normally be configured with a mating magnet 614 and media friction ring 612 for use as a clamp-bearing surface with the normal drive keeper. In one embodiment of the present invention, the normal drive keeper is replaced by the slim keeper 220, which clamps media 100 between the keeper and the media friction ring 612, aligned on center by the disc chuck hub 616. In another embodiment of the present invention, the drive 202 spindle and hub may be configured with a hub bearing ring 620 to reduce potential deflections and data errors by the media, as the force of the slim keeper may deflect the surface of the media upward, as the media friction ring 612 may act as a fulcrum. The height hub bearing ring 620 is configured to be is approximately 0.001-0.002 inch lower than the media fiction ring 612, to prevent too severe a deflection and potential data read or write errors in the OPU laser's operation of the drive.

The print carriage 206 may be configured to remain in the capping position, move to the very front of the device over the drive or be positioned in between along path 70, to allow removal and replacement of the cartridge 10. A button on the front of the device or the user software 402~404 may be configured to signal the device 200 to position the cartridge into this cartridge replacement position.

As illustrated in FIG. 13, the device 200 may be configured to allow adjustment of the height of the carriage assembly 206 with its print cartridge 10 relative to the media and the slim keeper 220. One way this may be done is to add adjustments to the front end of the rods 224 so that they may be slightly raised or lowered in slot 228. Also, drive mount spacer 230 may be configured with adjusting nuts to slightly raise or lower the entire frame 210 relative to the drive 202 and thereby relative to the media surface 100. During manufacturing of the preferred embodiment of the present invention, several manual adjustments may be included in the configuration thereof. The very slim keeper 220 is mounted in bridge 222 that is slightly tapered, as shown in FIG. 13 to allow for configuring the carriage assembly 206 that holds print cartridge 10 at a slant 610, such that the print cartridge 10 nozzle plate 12 is closer to the outer edge 604 of the media than at the inner edge 606 of the media. As the print cartridge 10 moves along radial path 70, nozzle plate 12 traverses along line 610 slanted at angle 602 relative to the surface of the media 100. This slant 602 allows vertical height to progress inward at an increasingly slighter height increase to eventually intersect just above the top of the keeper 220 and its mounting bridge 222, while also permitting the nozzle plate closer proximity to the printing surface of the media 100 at point 604. For one embodiment of the present invention, to achieve satisfactory print quality, the typical height of the nozzle plate at point 604 is substantially 0.020 inch, while corresponding height of the nozzle plate above the media at point 606 is substantially 0.060-0.070 inches. These values are optimized for print quality considerations and clearance. Lower than this value at the outer media edge at point 604 may result in media rubbing the bottom of the nozzle plate, while higher than this value results in image blurring, due to ink jet drop elongation. Correspondingly, at the inner media area at point 606, a lower value than 0.060 inches may not provide adequate clearance for the nozzle to traverse over keeper 220, while a higher value will cause also printing distortion. The advantage of this slanted configuration and method to reduce image distortion is that the ink jet cartridge 10 and nozzle plate 12 are lowest at the outer edge of the media where the media is spinning at the greatest spin rate, double the inner edge spin rate. Thus this method and configurations enables improved image quality off-set radial printing in a simple solution.

In another embodiment of the present invention, the print cartridge 10 may be configured such that it traverses with nozzle plate 12 substantially parallel to the media at an optimal height of 0.060 inches or slightly closer as it approaches the inner media positions. In this configuration, a vertical lift may be configured into the radial pathway, such that as the print cartridge approaches the inner media area, the print cartridge is lifted slightly so as to nominally clear keeper 220 and bridge 222. This print cartridge lifting may be done by means of a vertical cam with a ramping profile to contour the print carriage assembly slightly update so as to clear the keeper 220. The lifting may also be done similarly using a position profile and by means of on actuator or motor attached to the print carriage assembly, which upon sensing the inner positions, activate the lifting actuation or motor to perform this lifting function. This print cartridge may also be lifted by means of partial or full servo to sense the height of the media or the keeper interference and activate the actuator or motor just sufficiently to set the proper print cartridge and nozzle plate height for printing. The servo function could be performed relatively autonomously by the control logic 420 or more actively under control of the firmware by the CPU 410. The motor or actuator may be configured to provide the vertical "Z-axis" motion by mounting in the print carriage with the addition of a vertical slide, rail, linkages, gears or any other appropriate mechanical translation method. The vertical motion may also be used to automatically or semi-automatically adjust or calibrate the print carriage vertical height relative to the disc drive and media height during manufacturing or during power-on test and calibration. As the tolerances of the slim keeper 220 only allow a small degree of variation, this automatic or semiautomatic calibration configuration and process may correct for slight mechanical variations in each drive as manufactured, mechanisms falling out of alignment though mishandling or during shipment, the gradual misalignment through wear or by settling of vibration isolation bearings in the disc drive assembly OPU sled mounting frame assembly. The vertical calibrations of the print carriage assemble relative to the drive media surface enhance printing results as was previously described In another embodiment of the present invention, the print cartridge 10 may be configured as a low profile ink head cartridge with integrated movement mechanism and service-station, as disclosed by Jones et al, some of whom are among the present inventors, (U.S. Pat. No. 6,910,750) previously referenced, which patent is incorporated herein by reference in its entirety for all purposes. Whereas in one embodiment of the present invention using a half-height drive and stand print cartridge, the overall height is constrained to at least 4.5 inches, or 3 computer bays; when configured with a low profile ink head cartridge the overall height may be under 3 inches, or two computer bays. When the low-profile cartridge is combined with a customized slimline drive as is customarily used in laptop computers, the overall height of the off-axis printer may be configured in a single half-height computer bay. Thus the off-axis radial printer may be configured in very compact arrangements, depending upon the aggregate height of the ancillary components such as the print cartridge and disc drive.

In another embodiment of the present invention, device 200 may be configured in tandem or as a set of three units, side-by-side, together in a common frame with connections for a standard 18-inch rack mount. In this configuration, the units may act in tandem or individually; may share the I/O functions with one another. For example, in the preferred embodiment of the present invention, device 200 is configured as a compound USB device that includes 4-port USB hub as part of the I/O 406, which may be configured to attach two other devices configured without this hub, consolidating the design and saving cost. Similarly, a pair or a triplet of devices 200 may be configured to share loading and unloading media by a common side-shuttle loader and unloading, and may include a media holding and finished media output area all within this rack configuration, or a output bin attached to the front or rear. This loading may be configured to load and unload via the drive tray or the devices 200 may be configured to load media directly onto the chuck; in this method, the keeper assembly is mounted on a operable arm or wishbone bracket that may be lifted out of place with an actuator or motor during loading and unloading, then returned to grip the media. In this case the print carriage 206 is positioned rearward in the home position to provide clearance of the load or unloading shuttle mechanism. This shuttle mechanism may be configured with media center or outside grippers, lifts, clamps or another means to remove the media directly from the chucking position rather than via the drive tray. The device 200 alternately may be configured with lowered sides along the media chucking area to allow side loading and unloading via a carrier or other mechanical transport, again directly into the media chucking area, bypassing the tray. In these configurations whereby the drive tray is bypassed, the drive may be configured and customized by design of the drive designer or may be modified from a standard drive; in the later case, the drive may be configured with electronic signal generators to simulate sensors and motor movements normally associated with the drive tray motion. In this way, the drive may operate transparent to the reconfiguration for mounting the media directly into the chucking area without the use of a disc tray In another embodiment of the present invention, a plurality of devices 200 may be vertically mounted in a computer bay or vertical rack to allow integration with robotics and duplication equipment. In this configuration, the robotics may be of a variety supplied by disc duplicator manufacturers, such as Microboards Manufacturing of Salidar, Calif., Condre of Chanhassen, Minn., AMTRAN of Atlanta, Ga., in conjunction with an off-axis radial printer software development kit ("SDK") Such an SDK allows integrators to directly and programmatically control the functions of the 400 and interface directly with 460. Such as system could be designed to automatically handling the loading and unloading of the device 200 media 100, burning via programmatic software libraries, such as that supplied by Sonic Solutions, of Novato, Calif., and then render and print the label using the off-axis radial printer SDK, then unload and deliver the disc to the output. Because of the unique single insertion of the device 200, mislabeled disc in these automated systems may be averted. Furthermore, device 200 SDK may be used in parallel with burning to pre-render the images during disc burning to reduce the overall burn and print cycle time.

In another embodiment of the present invention, the entire control system 460 and host computer 400 functions may be combined into a single physical apparatus 200 to create a stand-alone, non-host attached device, for example, using the previously described SoC and other system components. Such a device may be configured to operate independently in a stand-alone manner, with the addition of wired and wireless I/O, such as LCD observation window XXX, RF for TV or A/V output, digital cable modem, navigation and selection buttons, remote control IRDA, hard disk drive, solid-state or SRAM or Flash disk drive, digital film memory card interfaces, USB, Firewire, LAN networking, wireless networking, Bluetooth and the like, such that a user can send files and digital data to record onto media and label the media. Digital content may be transmitted to the device 200 through the I/O 406 from a variety of devices, such as computers, laptops, personal data assistants (PDAs), cell phones, digital music players (such as an iPod), personal video recorders (a PVR, such as a Tivo), wired or nearby wireless digital streaming servers and the like. Such a configured device 200 may also function in conjunction with a download server to interact with a content service provider or act as a point-of-sale device in or as a small kiosk, for users to download digital content directly and burn the contents directly to the media and print the label directly thereon. Such a device may be used to display, browse or review the contents of the media inserted therein on a monitor or TV, as well as perform the functions of the label designer 402 interactively through a monitor and TV, but generated and controlled through device 200. In another embodiment of the present invention, when configured to operate with a personal video recorder (PVR), such as a Tivo brand device, the functions of the host computer 400 may alternately be performed by the PVR, while the device 200 is attached through the PVR's I/O, such as a USB or network interface port. The PVR may serve as the host for receiving streaming digital broadcasts or a point-of-sale personal digital media kiosk for the user. In summary, alternative embodiments enable device 200 to function as a single-media-insertion, compact recording and labeling device in multiple applications.

In another embodiment of the present invention, where device 200 may be configured with an RF module to allow displaying information and menus on a television or other connection to a computer and/or monitor, device 200 may be used to preview digital content on the DVD or CD media or optional film card reader. An example of use with this configuration of the present invention may be to allow users to place digital film cards into the film card reader, record contents to CD or DVD drive, and print a label on the media 100 using the printer imaging control system 460 and printer assembly 210, browse the contents of the CD/DVD using menus on the TV and a remote to view pictures. The I/O 406 and driver 404 may be configured to allow an external photo printer to attach directly thereto, for example as a USB On-the-GO (OTG) interface, so that through the above stated browsing and selection process, the user can select and print a plurality of photos, all performed from the off-axis apparatus 200.

An observation window may be also configured to allow users to view the radial printing process, and the user may observe the status of recording and printing via a plurality of activity lights on the device. Other methods combining these activities in various sequences may be performed with the present invention.

By using this off-axis printer, as disclosed in referenced patent application herein, overall printer design size and heights may be even further reduced for all devices disclosed in the present invention. For example, the device may be configured to fit into a plurality of standard computer bay and interfaced directly thought the IDE, SATA, USB, SCSI, IEEE 1384 (Firewire) or any similar interface within the computer. Multiple off-axis apparatuses 200 may be configured and arranged into a plurality of computer bays and operated in series, tandem or parallel fashion for recording data and printing labels through one insertion each respectively of the media. For example these may be stacked into a computer bay and configured with robotics and robotic control systems to move media into and out of the plurality of off-axis apparatuses 200 in a plurality of computer system bays.

In another embodiments of the present invention, the printing mechanism may be configured as a standalone unit that can receive data input from sources such as memory cards, mp3 players, the Apple iPod and its interface, picture phones, handheld computers, telephone wireless connection, WIFI connection, infrared connection, or bluetooth connection, without the use of a host computer and then transfer data from the memory card to and record on a CD or DVD and also print a label comprising graphics and or text representing aspects of the data recorded onto the CD. Such labels may be in the form of preconfigured templates relating to types of data burned on the CD's or DVD's and may optionally be selected by the user via interface on the mechanism. For example, songs from an mp3 player maybe recorded or backed up onto a CD or DVD directly by plugging in the mp3 player then the list of table of contents formatted from a plurality of preconfigured templates, such as A, B or C, that arrange the list of context respectively according to the prearranged template style. It may also include date or size information of the file content, along with names of files and similar attributes. For example the template may print the file names on the left side with option A, or on the bottom and right side with B including today's date, and so on in a plurality of possibilities. In another example, when the memory card contains data representing digital pictures, the label may product thumbnail representations or all or some of the pictures. It may also include date information relating to all or some of the pictures. For example, the mechanism may print only a thumbnail of the first picture of each date of pictures on the memory card, thereby providing an index of days or events represented by the pictures. Alternatively, the thumbnails could comprise the first few and last few of a group of pictures with the current date, all generated automatically by the mechanism.

In an alternative embodiment, the mechanism could receive information relating to video data via standard means, such as 1394 connection, USB connection, wired or wireless video streaming, or analog/audio/video inputs. The mechanism could automatically or at the user's option print on the label thumbnails comprising a unique frame of the video data for each separate scene or date represented by the video data. Alternate schemes for printing of thumbnails representing the video data can be configured. In another embodiment the mechanism can include sufficient data memory buffer so that for real time data streaming, the user could be prompted to remove a filled disc and replace with a fresh disc, while the mechanism could print label information including consecutive numbers for disc identity in a series, such as "disc 1" or "disc 2." Additionally with sufficiently large memory buffer additional copies of a disc could be created and also labeled.

In another embodiment of the present invention could include an image scanning mechanism over the media so that label information of an existing disc could be scanned, copied, and replicated on a copy disc while the disc is spinning. The off-axis printer translates the on-axis scanned information into correct positions to place the respective ink objects for properly proportioned labeling. The digital contents of the original disc could also be copied onto the copy disc in the same or sequential operation.

The previously described embodiments may be configured to operate either in a standalone mode or in conjunction with a host computer or data processing apparatus. In summary, the exemplary concept and novel use of the off-radial-axis circular printer as defined in the present invention illustrate the overall principle and application of the more general solution for a highly integrated system for recording and label printing circular media in a single insertion of the media. Therefore, the described embodiments should be taken as illustrative only and not restrictive, and the invention should not be limited to the details given herein but should be defined by the following claims and their full scope of equivalents.

What is claimed is:

1. A method for printing onto a rotating media, comprising:

rotating the media;

providing a print head with two or more nozzles wherein at least one of the two or more nozzles is laterally displaced from a radial printing radius; and printing an image comprising one or more print points within an annular print area;

wherein selection of laterally displaced nozzles for firing is based upon a comparison of polar radii of laterally displaced nozzles on the print head to the polar radius of at least one of the print points.

2. The method of claim 1, wherein the print head is substantially parallel to the radial printing radius.

3. The method of claim 1, wherein the annular print area is defined by an inner hub circumference, two lines substantially parallel to the radial printing radius and tangential to the inner hub circumference, and an outer edge of the media.

4. The method of claim 1, wherein the print head is an ink print head having a plurality of nozzles dispensing ink onto the rotating media.

5. The method of claim 1, wherein the media includes an optical data storage disc.

6. The method of claim 1, further comprising receiving a command to rotate the media at a low speed.

7. The method of claim 1, wherein selection of laterally displaced nozzles to fire is based upon selecting the nozzle located at a polar radius closest to the polar radius of a particular print point.

8. A label printing system for a rotating media, comprising:

a rotation mechanism for rotating the media;

a print head with two or more nozzles wherein at least one of the two or more nozzles is laterally displaced from a radial printing radius;

a controller for selecting laterally displaced nozzles to fire;

a controller for causing the print head to print one or more print points onto an annular print area;

wherein selection of laterally displaced nozzles for firing is based upon a comparison of polar radii of laterally displaced nozzles on the print head to the polar radius of at least one of the print points.

9. The system of claim 8, wherein the print head is substantially parallel to the radial printing radius.

10. The system of claim 8, wherein the print head is an ink print head having a plurality of nozzles dispensing ink onto the rotating media.

11. The system of claim 8, wherein the annular print area is defined by an inner hub circumference, two lines substantially parallel to the radial printing radius and tangential to the inner hub circumference, and an outer edge of the media.

12. The system of claim 8, wherein the media is inserted and ejected from the apparatus using a robotic control system.

13. The system of claim 8, wherein the apparatus receives data from a memory card, a media player, a cellular phone, or a handheld computers.

14. The system of claim 8, wherein the system further provides wireless with data input source.

15. The system of claim 8, further comprising a motion mechanism coupled with the print head to allow movement of the print head over the rotating media.

16. The system of claim 15, wherein the movement is parallel to the radial printing radius.

17. The system of claim 16, wherein the movement is perpendicular to the radial printing radius.

18. The system of claim 8, further comprising a print cartridge maintenance mechanism.

19. The system of claim 18, wherein the print cartridge maintenance mechanism further comprising a cartridge carriage, a wiper mounted substantially parallel to the carriage, and a cap, wherein during printing, the cap is opened to allow unsealing of the nozzles.

20. The system of claim 19, wherein after printing is completed, the cap covers the nozzles to prevent dehydration or potential clogging.

21. The system of claim 8, wherein the system is a standalone device.

22. The system of claim 21, further comprising a control system and an input and output.

23. The system of claim 21, wherein a user selects one or more contents to be recorded and designs a label without connecting to a computer device.

24. The system of claim 21, further comprising a display.

25. The system of claim 8, wherein the system allows high-speed USB 2.0, USB hub, USB IDE/ATAPI bridge, USB device, DMA transfers, Firewire, LAN, Ethernet, WIFI, or Bluetooth connectivity.

26. A label printing system, comprising:

a plurality of printing devices for a rotating media, each comprising, a rotation mechanism for rotating the media;

a print head with two or more nozzles wherein at least one of the two or more nozzles is laterally displaced from a radial printing radius;

a controller for selecting laterally displaced nozzles to fire;

a controller for causing the print head to print one or more print points in an annular print area;

wherein selection of laterally displaced nozzles for firing is based upon a comparison of polar radii of laterally displaced nozzles on the print head to the polar radius of at least one of the print points; and wherein the plurality of printing devices are configured to operate as a unit.

27. The system of claim 26, wherein the system is integrated with an automated system for use in duplication manufacturing.

28. The system of claim 26, further comprising a media loader for loading a media to the plurality of printing devices.

29. A label printing system for a rotating media, comprising:

a print head with two or more nozzles wherein at least one of the two or more nozzles is laterally displaced from a radial printing radius;

a controller for selecting laterally displaced nozzles to fire;

a controller for causing the print head to print one or more print points in an annular print area; and a mounting mechanism to mount the printing system to an optical recording device;

wherein selection of laterally displaced nozzles for firing is based upon a comparison of polar radii of laterally displaced nozzles on the print head to the polar radius of at least one of the print points.

30. The system of claim 29, further comprising a print head height adjustor to adjust a distance of the print head from the media's surface.

31. The system of claim 29, wherein the printing system is mounted to the optical recording device horizontally.

32. The system of claim 29, wherein the printing system is mounted to the optical recording device vertically.

* * * * *